US006290091B1

(12) United States Patent
Bell

(10) Patent No.: US 6,290,091 B1
(45) Date of Patent: Sep. 18, 2001

(54) HOT OR COLD BEVERAGE CONTAINER HOLDER

(75) Inventor: Allen Ray Bell, Gig Harbor, WA (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/652,467

(22) Filed: Aug. 31, 2000

(51) Int. Cl.[7] ..... B65D 3/28
(52) U.S. Cl. ..... 220/739; 229/403; 229/405
(58) Field of Search ..... 220/739; 229/403, 229/405

(56) References Cited

U.S. PATENT DOCUMENTS

| | | | | |
|---|---|---|---|---|
| D. 282,234 | | 1/1986 | Henderson . | |
| 405,413 | * | 6/1889 | Hicks | 229/117.06 |
| 2,337,199 | * | 12/1943 | Holy | 229/117.06 |
| 3,630,430 | * | 12/1971 | Struble | 229/117.06 |
| 4,185,764 | * | 1/1980 | Cote | 229/117.06 |
| 4,267,955 | * | 5/1981 | Struble | 229/117.06 |
| 4,410,129 | * | 10/1983 | Wischusen, III | 229/117.06 |
| 4,540,611 | | 9/1985 | Henderson . | |
| 4,648,525 | | 3/1987 | Henderson . | |
| 5,156,294 | * | 10/1992 | Nichols | 229/117.06 |
| 5,169,025 | * | 12/1992 | Guo | 220/739 |
| 5,425,497 | | 6/1995 | Sorensen . | |
| 5,445,315 | * | 8/1995 | Shelby | 229/117.06 |
| 5,842,633 | | 12/1998 | Nurse . | |
| 5,845,806 | * | 12/1998 | Parchman | 200/739 |
| 6,026,983 | * | 2/2000 | Graham | 220/739 |
| 6,059,140 | * | 5/2000 | Hicks | 220/739 |

* cited by examiner

*Primary Examiner*—Joseph M. Moy
(74) *Attorney, Agent, or Firm*—Bullwinkel Partners, Ltd.

(57) ABSTRACT

A substantially cylindrical beverage container holder manufactured from a sheet of recycled pressed paper pulp is provided. The sheet is die cut form a blank having large and small opposing substantially rectangular sides connected by a bottom portion. The large side has a center panel and two glue flaps attached to the center panel by vertical fold lines. The bottom portion is substantially circular to conform to the shape of a beverage can and has fold lines that allow the blank to be folded so that the two rectangular sides are brought together in facing relationship. The large side glue flaps are glued to the small side to form a flat holder having vertical edges. The holder is opened by gently squeezing along the vertical edges, thereby creating an open top end for receiving a beverage container.

15 Claims, 4 Drawing Sheets

HOT OR COLD BEVERAGE CONTAINER HOLDER

BACKGROUND

1. Field Of The Invention

This patent relates to a beverage container holder for hot or cold liquids. More particularly, this patent relates to a beverage container holder that is made from a single sheet of insulative material and collapses for easy shipping and storage.

2. Description Of The Related Art

Aluminum cans and glass bottles are commonly used as containers for keeping and serving cold beverages. Hot beverages such as coffee or tea, especially those served by take out shops, are often served in laminated paperboard cups. While these containers are undeniably popular, they all share the same disadvantage. Aluminum, glass and, to a lesser extent, paperboard, are poor insulating materials. Containers made from these materials tend to allow a large amount of heat transfer to or from the liquid contents. Thus cold beverages served in aluminum cans or glass bottles tend to gain heat quickly while hot beverages served in relatively thin laminated paperboard cups tend to lose heat quickly when exposed to ambient temperatures.

A number of beverage container holders have been proposed to reduce the amount of heat transfer to or from a cold or hot beverage. For example, Henderson U.S. Pat. No. 4,540,611 teaches an insulated beverage container holder made of insulative foam that can be collapsed for easy storage and reused. The holder is made from a single sheet of foam material cut into two identical rectangular halves connected by a bottom portion shaped to conform to the shape of a beverage container. The two halves are folded on top of each other and stitched or vinyl welded together to form the holder. Henderson Pat. U.S. No. 4,648,525 teaches a two-piece foam insulative beverage container holder made from a sheet of insulative foam material folded into the shape of a cylindrical beverage container holder and then held together by a strip of seam tape affixed to a vertical seam. While both of these holders are suitable for their particular purpose, neither is made from recyclable paper materials. Furthermore, both require an additional vinyl layer as a printing media for decorative graphics or advertising. Although collapsible, the foam material takes up more space than pressed paper materials.

Other references disclose sleeve-type holders without a bottom for holding hot beverage containers. For example, Sorenson U.S. Pat. No. 5,425,497 teaches a sleeve type beverage container holder made from an arcuate web of pressed paper pulp with opposite extending partial slits so that the web can be rolled into a frusto-conical shape with the slits interlocked. A cup may then be inserted into the open top of the holder and held by grasping the holder. The pressed paper pulp is textured to increase the insulative property of the holder. Similarly, Nurse U.S. Pat. No. 5,842,633 teaches a sleeve-type beverage cup holder having oppositely extending tabs that can be interlocked to form a frusto-conical cup holder. Both sleeve-type patents eliminate the need for nesting two cups together for serving hot beverages. However, both provide only a limited amount of insulation due to the limited area of the cup that is wrapped by the insulative sleeve. Furthermore, neither sleeve-type holder is suitable for holding cylindrical cans or bottles containing cold beverages.

Thus it is an object of the present invention to provide an insulative beverage container holder that can be made from a single sheet of material.

Another object of the invention is to provide a beverage container holder that can be manufactures using between 98 and 100 percent post consumer raw materials.

Still another object of the invention is to provide a beverage container holder that can accept printing and embossing without the need for lamination.

Yet another object of the invention is to provide a beverage container holder that collapses flat for ease of storage and shipping.

Still another object of the invention is to provide a beverage container holder that reduces the amount of heat transferred to or from the beverage.

Further and additional objects will appear from the description, accompanying drawings, and appended claims.

SUMMARY OF THE INVENTION

The present invention is a collapsible beverage container holder formed from a single blank. The blank comprises large and small substantially rectangular sides connected by a bottom portion. The large substantially rectangular side has a top edge and a bottom edge, a center panel extending from the top edge to the bottom edge, and opposing side flaps hingedly connected to the center panel along vertical fold lines extending between the top and bottom edges. The small substantially rectangular side has a top edge and a bottom edge and is substantially equal in size and shape to the large side center panel. The bottom portion comprises a center section and opposing flanges. The opposing flanges are hingedly connected to the bottom edges of the large and small sides respectively along peripheral fold lines. The blank is folded so that the a large and small sides are brought into facing relationship and the large side opposing side flaps are glued to the second side.

Preferably, the fold lines are either slit scored or perforated to facilitate easy folding. The beverage container holder may be made from post consumer raw materials such as pressed pulp paper, or other suitable materials. The holder can be printed or embossed with graphics for advertising or aesthetic purposes. The beverage container holder may be folded for easy shipping and storage. The holder partially insulates the beverage container, thereby reducing the amount of heat transfer to or from the beverage.

THE DRAWINGS

DETAILED DESCRIPTION OF THE INVENTION

Turning to the drawings, there is shown in FIGS. 1–6 a hot or cold beverage container made according to the present invention. The beverage container holder 10 is made from a single blank that is folded and glued to form a substantially cylindrical holder having a saddle type bottom. The holder 10 is foldable may be made from recycled materials.

Figure 1:
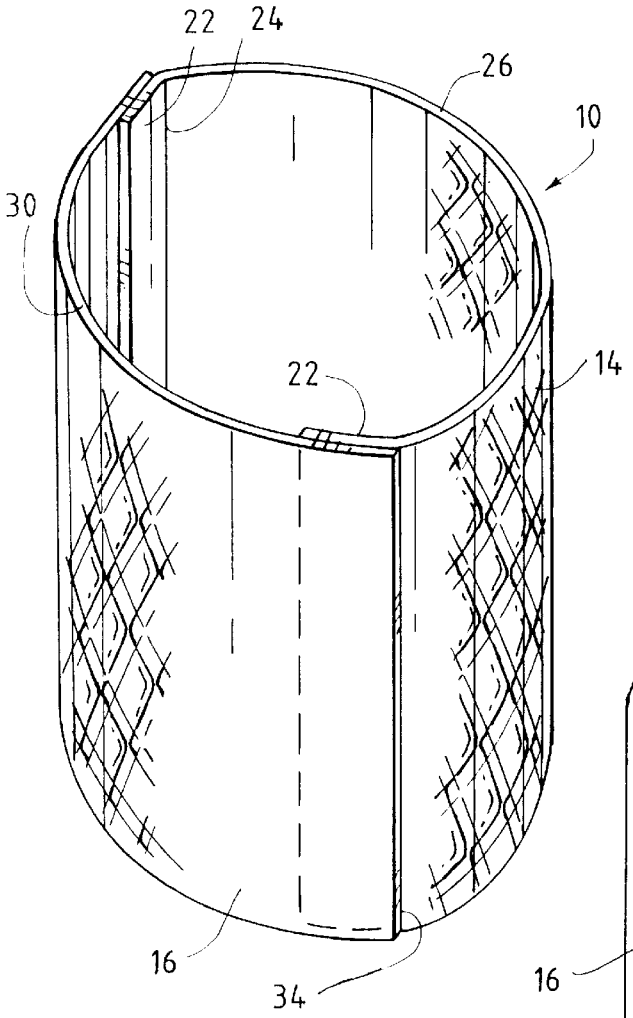
FIG. 1 is a top perspective view of the beverage container holder of the present invention in the open position.
Figure 2:
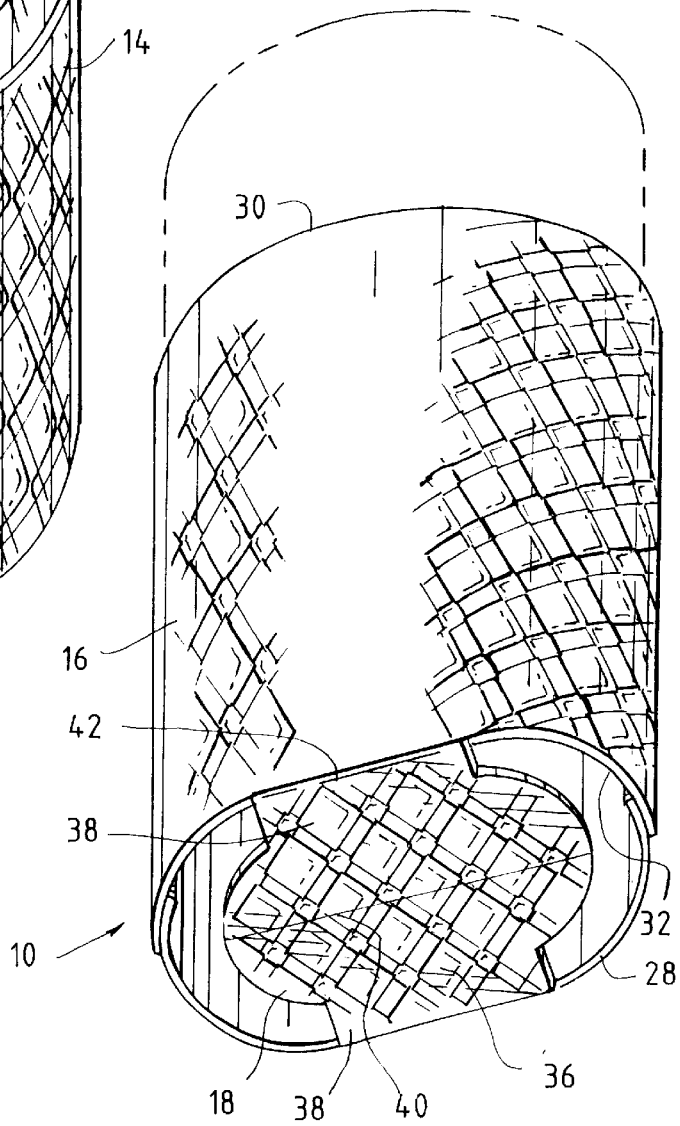
FIG. 2 is a bottom perspective view of the beverage container holder of FIG. 1 in the open position.
Figure 3:
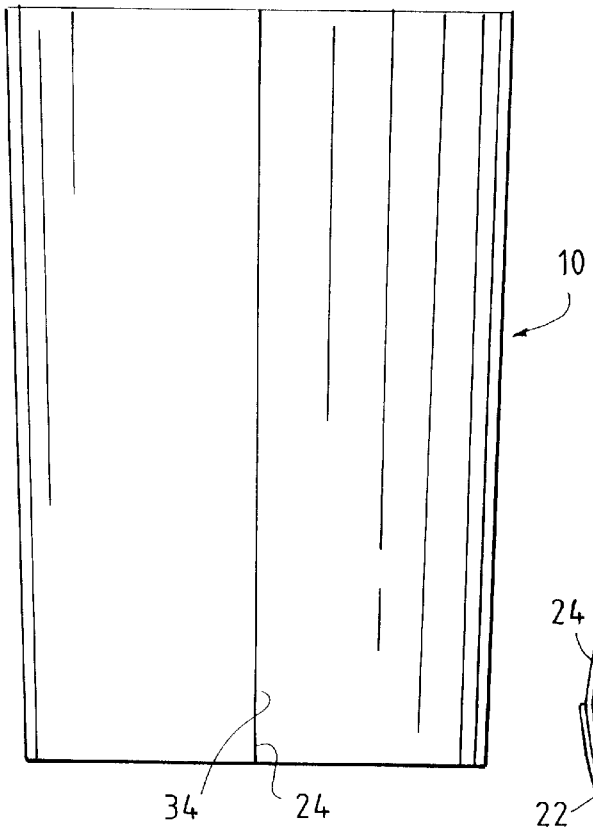
FIG. 3 is a side plan view of the beverage container holder of FIG. 1 in the open position.
Figure 4:
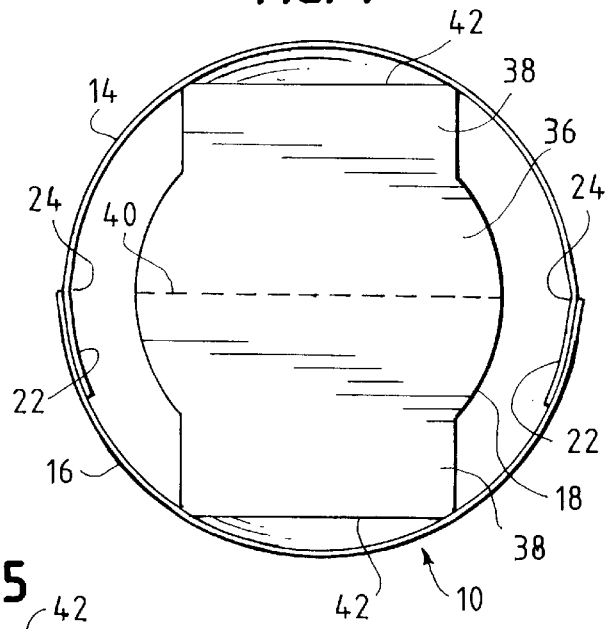
FIG. 4 is a top plan view of the beverage container holder of FIG. 1 in the open position.
Figure 5:
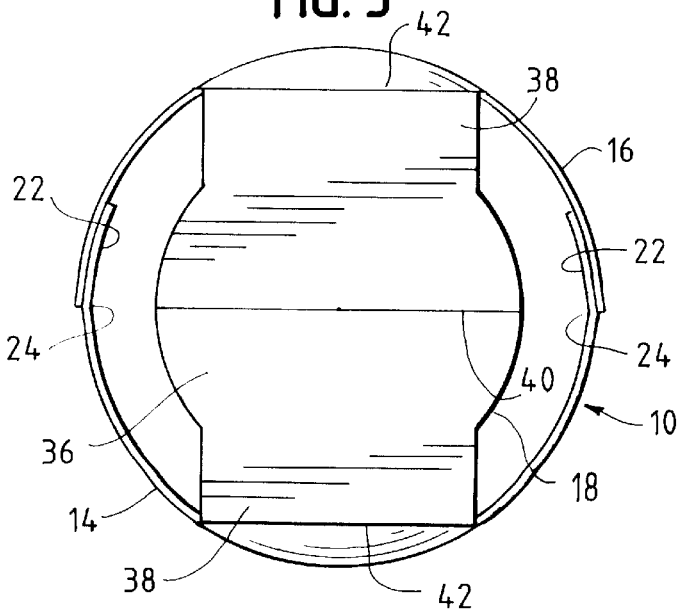
FIG. 5 is a bottom plan view of the beverage container holder of FIG. 1 in the open position.
Figure 6:
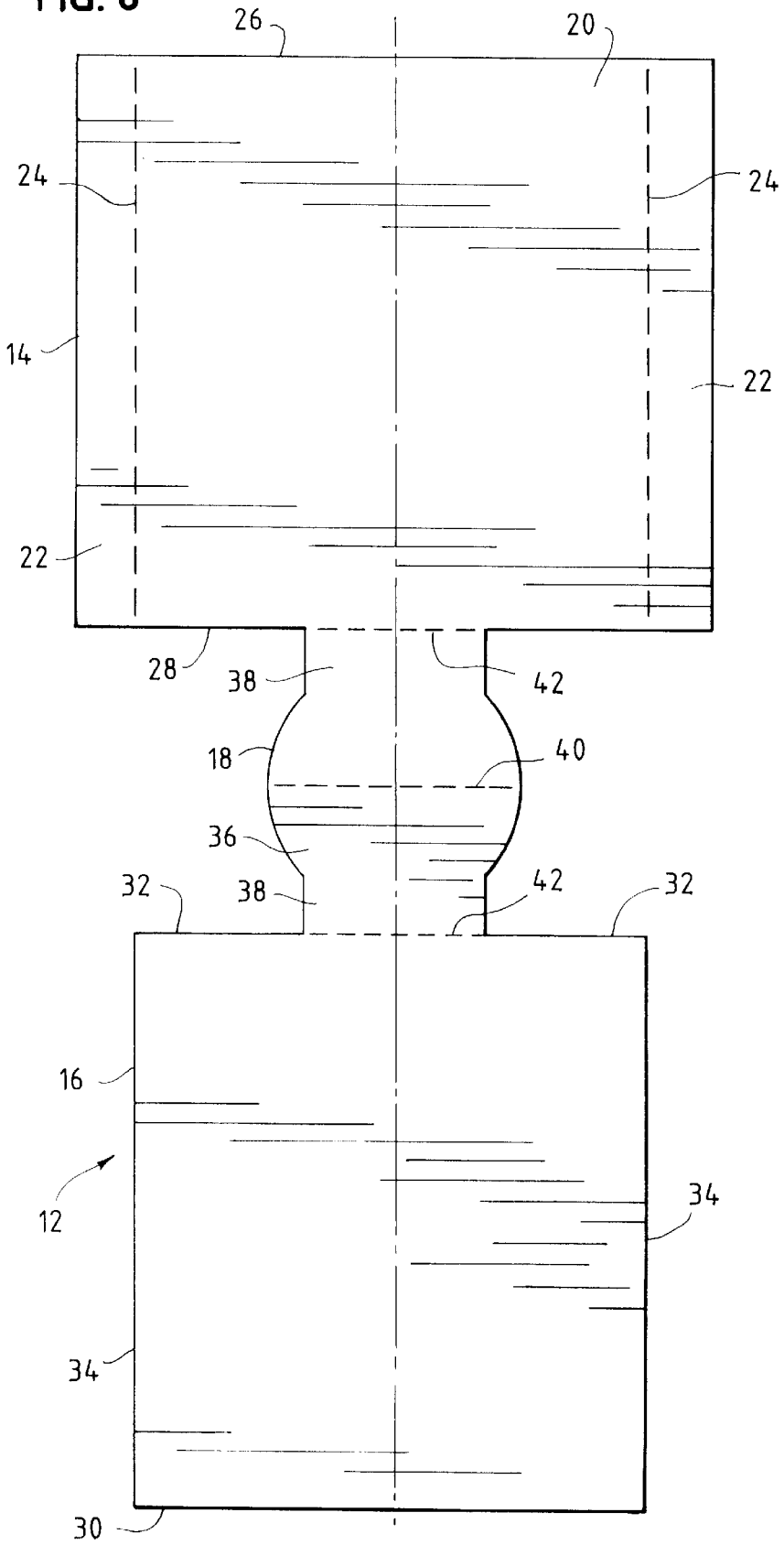
FIG. 6 is a top plan view of a blank used to form the beverage container holder of FIG. 1.

FIG. 6 is a top plan view of a blank 12 used to form the beverage container holder 10. The blank 12 comprises two substantially rectangular sides 14, 16 connected by a bottom portion 18. The rectangular sides are hereinafter referred to as the larger side 14 and the smaller side 16 due to their relative sizes. A centerline C is defined as the line running through both sides 14, 16 and the bottom portion 18, dividing the blank into two mirror-image halves. The sides 14, 16 have identical vertical dimensions, i.e. the dimensions in the direction of the centerline C. However, the larger side 14 has a larger horizontal dimension, i.e. the dimension in the direction perpendicular to the centerline C.

The larger side 14 comprises a center panel 20 and two opposing glue flaps 22. The glue flaps 22 are separated from the center panel 20 by vertical fold lines 24 extending from the top edge 26 of the large side 14 to the bottom edge 28 and parallel to the centerline C. The center panel 20 has the same vertical and horizontal dimensions as the smaller side 16. Thus, the area of the large side 14 exceeds that of the small side 16 by an amount equal to the area of the two glue flaps 22.

The small side 16 has a top edge 30 away from the bottom portion 18, a bottom edge 32 opposite the top edge 30, and side edges 34. As explained below, the small side 16 and the large side 14 cooperate to form the substantially cylindrical side of the beverage container holder 10.

The bottom portion 18 comprises a center section 36 connected to the large and small sides 14, 16 by flanges 38. Preferably, the center section 36 is substantially circular to conform to the shape of the bottom of the beverage container, although other shapes are contemplated that do not depart from the spirit and scope of the invention while still providing support and stability for the beverage container, such as rectangular or hexagonal. The substantially circular section 36 has a diameter less than the diameter of the beverage container that is to be held in the assembled holder 10, but large enough to support the beverage container. A transverse fold line 40 intersects the center point of the circular section perpendicular to the centerline C to facilitate folding, as explained below.

The bottom portion flanges 38 are connected to the large and small sides 14, 16 along peripheral fold lines 42. The peripheral fold lines 42 are co-linear with the bottom edges of the large and small sides in FIG. 6 and, along with the bottom edges, form the substantially circular bottom periphery of the open beverage container holder 10 shown in FIGS. 1–5.

The fold lines 24, 40, 42 may be either perforated or slit scored to facilitate easier folding. In the preferred embodiment, a multiple ply sheet is slit scored such that at least one ply remains uncut along each fold line.

Figure 7:
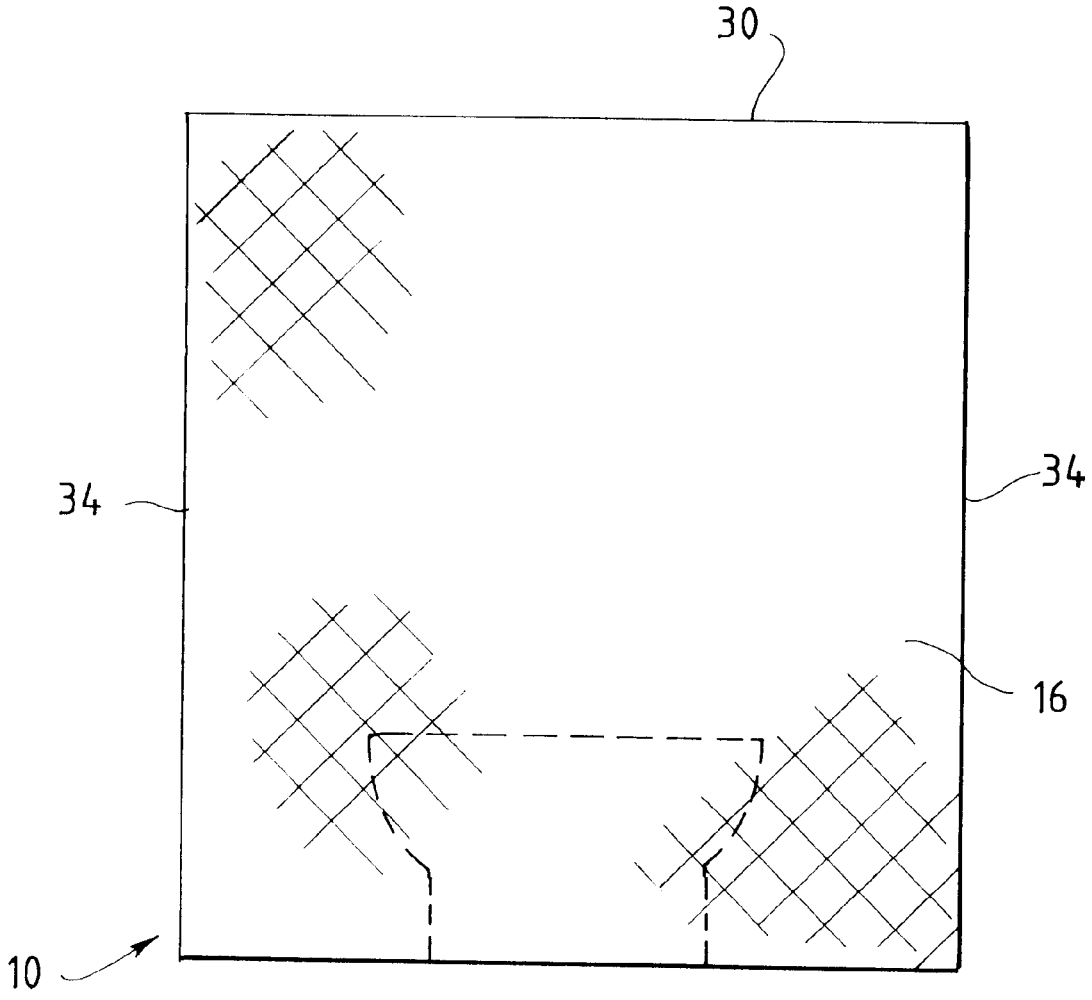
FIG. 7 is a side plan view of the beverage container holder of FIG. 1 in the collapsed position.

The beverage container holder 10 may be assembled in the following manner. A sheet of suitable insulating material is manufactured and then printed and/or embossed with any desired graphics. A blank 12 is die cut from the sheet. The blank 12 is folded along peripheral fold lines 42 and along transverse fold line 40 so as to bring the sides 14, 16 together in facing relationship, preferably with the bottom 18 interposed between the sides 14, 16 as shown in FIG. 7. At the same time, the glue flaps 22 are folded inward along lines 24 and glued to the inside wall of the small side 16. The result is the beverage container holder 10 in the collapsed position, ready for packing and shipping.

To use the beverage container holder 10, the user simply squeezes the holder 10 with his or her thumb and fingers along the vertical edges 34 of the flat collapsed holder 10 (FIG. 7). When in the open position shown in FIGS. 1–5, the beverage container holder 10 is substantially cylindrical, having an open top end and a partial bottom to support the beverage container. The user may then place a hot or cold beverage container into the open top end of the holder 10.

In one anticipated embodiment, the dimensions of the large and small sides 14, 16 and the bottom 18 are such that, when the blank 12 is assembled into a substantially cylindrical holder 10, a standard twelve ounce aluminum beverage container fits snugly inside. However, it is contemplated that the sides and bottom can be made in other dimensions to accommodate other sized cylindrical containers.

Preferably, the holder 10 is manufactured using between 98 and 100 percent post consumer materials, such as recycled pulp paper, although other materials that provide some insulative properties can be used. In the preferred embodiment the pulp paper material is quilted to provide texture for ease of handling and thickness for improved insulative properties.

Other modifications and alternative embodiments of the invention are contemplated which do not depart from the spirit and scope of the invention as defined by the foregoing teachings and appended claims. It is intended that the claims cover all such modifications that fall within their scope.

I claim as my invention:

1. A collapsible beverage container holder formed from a single blank, said blank comprising:

a first substantially rectangular side having a top edge and a bottom edge, a center panel extending from the top edge to the bottom edge, and opposing side flaps hingedly connected to the center panel along vertical fold lines extending between the top and bottom edges;

a second substantially rectangular side having a top edge and a bottom edge, said first side center panel and second side having substantially identical dimensions; and a bottom portion having a substantially round center section and opposing substantially rectangular flanges extending therefrom, said flanges hingedly connected to the bottom edges of the first and second sides respectively along peripheral fold lines, said bottom portion having a transverse fold line intersecting a center point of the substantially round center section and parallel to the peripheral fold lines, said peripheral fold lines being shorter than the transverse fold line;

said holder assuming a flat substantially rectangular shape when collapsed;

wherein squeezing the collapsed holder along the vertical fold lines causes the holder to assume a substantially round cylindrical shape for receiving a beverage container.

2. The beverage container holder of claim 1 wherein the opposing side flaps are glued to the second side.

3. The collapsible beverage container holder of claim 1 wherein, when the holder is in a collapsed position, the bottom portion is interposed between the first and second substantially rectangular sides.

4. The collapsible beverage container holder of claim 1 wherein, when the holder is in a collapsed position, the bottom portion extends outwardly away from the first and second substantially rectangular sides.

5. The beverage container holder of claim 1 wherein the vertical, peripheral and transverse fold lines are slit scored.

6. The beverage container holder of claim 1 wherein the vertical, peripheral and transverse fold lines are perforated.

7. The beverage container holder of claim 1 wherein the blank is made substantially from pressed pulp paper.

8. The beverage container holder of claim 7 wherein the pressed pulp paper is made from post consumer raw materials.

9. The beverage container holder of claim 8 wherein the blank is formed from a quilted multiple ply sheet.

10. The beverage container holder of claim 8 wherein the multiple ply sheet is printed with graphics.

11. A substantially round cylindrical beverage container holder comprising a die cut blank having large and small opposing substantially rectangular sides connected by a bottom portion, said large side having top and bottom edges, a center panel extending from the top edge to the bottom edge and two flaps separated from the center panel by vertical fold lines extending from the top edge to the bottom edge, said bottom portion having a substantially round center section and opposing substantially rectangular flanges, said center section having a transverse fold line parallel to the large and small side bottom edges, said flanges connected to the bottom edges along peripheral fold lines, said blank being folded along the transverse fold line and the peripheral fold lines to bring the opposing sides together in facing relationship, said large side flaps being glued to the small side.

12. The beverage container holder of claim 11 wherein the fold lines are slit scored.

13. The beverage container holder of claim 11 wherein the fold lines are perforated.

14. The beverage container holder of claim 11 wherein the vertical and horizontal dimensions of the large side center panel are substantially the same as the vertical and horizontal dimensions of the small side.

15. The beverage container holder of claim 11 wherein the blank is manufactured from post consumer raw materials.

* * * * *